US007158748B2

(12) United States Patent
Kwak et al.

(10) Patent No.: US 7,158,748 B2
(45) Date of Patent: Jan. 2, 2007

(54) FUSING DEVICE OF AN IMAGE FORMING APPARATUS AND METHOD THEREOF

(75) Inventors: In-gu Kwak, Yongin-si (KR); Il-han Park, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 169 days.

(21) Appl. No.: 10/960,093

(22) Filed: Oct. 8, 2004

(65) Prior Publication Data

US 2005/0147435 A1 Jul. 7, 2005

(30) Foreign Application Priority Data

Jan. 5, 2004 (KR) ..... 10-2004-0000363

(51) Int. Cl.
*G03G 15/20* (2006.01)

(52) U.S. Cl. ..... 399/330; 219/216; 219/619; 399/328

(58) Field of Classification Search ..... 399/328, 399/329, 330, 333; 219/216, 619, 469; 430/124; 347/156

See application file for complete search history.

(56) References Cited

U.S. PATENT DOCUMENTS 5,819,149 A * 10/1998 Watanabe et al. ..... 399/330
6,031,215 A * 2/2000 Nanataki et al. ..... 219/619
6,049,691 A * 4/2000 Abe et al. ..... 399/330
6,341,211 B1 1/2002 Tsujimoto et al. ..... 399/330
2001/0019676 A1* 9/2001 Okubo et al. ..... 399/328
2004/0238531 A1* 12/2004 Kikuchi et al. ..... 219/619 X

FOREIGN PATENT DOCUMENTS

JP 09-096974 A * 4/1997
JP 2000-192943 7/2000
JP 2001-154521 6/2001
JP 2002-055549 2/2002
JP 2002-351240 12/2002

* cited by examiner

*Primary Examiner*—Sophia S. Chen
(74) *Attorney, Agent, or Firm*—Roylance, Abrams, Berdo & Goodman, L.L.P.

(57) ABSTRACT

A fusing device of an image forming apparatus and method thereof are provided. The fusing device and method include a conductive member having a linear portion for contacting a printing medium, a fusing film for sliding on a circumference of the conductive member, a pressing roller for contacting the fusing film in the linear portion, forming a fusing nip area, and rotating the fusing film, and an induction heating unit for heating the conductive member by induction and generating heat. The thickness of the conductive member in the fusing nip area is smaller than the thickness of the conductive member in other areas.

16 Claims, 8 Drawing Sheets

FUSING DEVICE OF AN IMAGE FORMING APPARATUS AND METHOD THEREOF

PRIORITY

This application claims the benefit under 35 U.S.C. 119(a) of Korean Patent Application No. 2004-363, filed on Jan. 5, 2004, in the Korean Intellectual Property Office, the entire contents of which is incorporated herein by reference.

BACKGROUND OF THE INVENTION

1. Field of the Invention

The present invention relates to a fusing device of an image forming apparatus and method thereof. More particularly, the present invention relates to a fusing device of an image forming apparatus and method thereof which locally heats a fusing nip area.

2. Description of the Related Art

In general, a copier, a printer, a facsimile, and a multi-functional device which provides all functions of the copier, the printer, and the facsimile, have a printing function in common. These devices are referred to as an image forming apparatus.

The image forming apparatus includes a fusing device which heats and presses a sheet of paper onto which a toner image is transferred, melts the powdery toner image on the sheet of paper, and fuses the melted toner image on the sheet of paper. The fusing device includes a heating unit which generates heat, and a pressing roller which forms a fusing nip with the heating unit, applies pressure thereto, and helps the toner melt.

The fusing unit melts the toner when the fusing unit is heated to a predetermined temperature, for example, 180° C. Means for heating the fusing unit include a halogen lamp, a resistive coil, or an induction heating coil.

FIGS. 1 and 2 are cross-sectional views illustrating a conventional induction heating-type fusing device according to an embodiment disclosed in U.S. Pat. No. 6,341,211.

Referring to FIGS. 1 and 2, the fusing device includes a conductive member 12 which is a hollow structure fixed in an unrotated state and melts toner 11 on a sheet of paper 10 thermally, a pressing roller 13 which closely presses the sheet of paper 10 having the toner 11 toward the conductive member 12, a traveling belt 20 which is interposed between the fixed conductive member 12 and the pressing roller 13 and transfers the sheet of paper 10, and a coil 14 which inductively heats the conductive member 12. The pressing roller 13 moves in a direction of an arrow B, and the traveling belt 20 is rotated in a direction of an arrow A as the pressing roller 13 moves in the direction of the arrow B.

The conductive member 12 comprises a hollow pipe and comprises one of a carbon steel pipe, a stainless alloy pipe, an aluminum pipe, and iron.

The pressing roller 13 includes an axial core 15 and a silicon rubber layer 16 formed at a circumference of the axial core 15. The pressing roller 13 is pressed in a direction of the conductive member 12 using a spring member (not shown).

A rectangular core 17 forms a closed magnetic circuit, and a part thereof perforates a hollow portion 12*a* of the conductive member 12. The coil 14 is wound around the core 17. When a current flows through the core 17, magnetic flux by which an inductive current is generated along a circumferential direction of the conductive member 12 is produced.

The core 17 is an iron core used in a general transformer. An insulating layer 22 electrically insulates the coil 14 from the core 17.

FIG. 3 shows the structure of a conventional induction heating-type fusing device according to another embodiment disclosed in U.S. Pat. No. 6,341,211. The same reference numerals are used for the same elements as those of the conventional fusing device, and detailed descriptions thereof will be omitted.

The difference between the embodiment of FIGS. 1 and 2 and the embodiment of FIG. 3 is that the core 17 and the conductive member 12 in the embodiment of FIGS. 1 and 2 have a rectangular shape and, in the embodiment of FIG. 3, a conductive member 12' is a cylindrical roller. Since the other elements are substantially the same, the same reference numerals are used, and detailed descriptions thereof will be omitted.

In the conventional fusing device, since the conductive members 12 and 12' are uniformly heated by induction, a heating unit is heated to maintain a temperature required for a fusing operation, and the heat loss is significant. In addition, it is difficult to obtain a uniform fusing property due to heat loss at both ends of the conductive members.

SUMMARY OF THE INVENTION

The present invention provides a fusing device of an image forming apparatus and method in which heat generated at a conductive member by inductive heating is densely concentrated in a fusing nip area.

The present invention also provides a fusing device of an image forming apparatus and method in which a fusing unit is uniformly heated in a lengthwise direction.

According to an aspect of the present invention, there is provided a fusing device of an image forming apparatus and method thereof. The fusing device and method comprise a conductive member having a linear portion for contacting a printing medium; a fusing film for sliding on a circumference of the conductive member; a pressing roller for contacting the fusing film in the linear portion, forming a fusing nip area, and rotating the fusing film; and an induction heating unit for heating the conductive member by induction and generating heat, wherein the thickness of the conductive member in the fusing nip area is smaller than the thickness of the conductive member in other areas.

The induction heating unit can comprise a core perforating a hollow of the conductive member and forming a magnetic circuit; a coil surrounding an outer circumference of the core spirally; and an AC voltage source applying a predetermined AC voltage to both ends of the coil.

The fusing device can further comprise an insulating layer formed between the coil and the core.

A number of turns of the coil at both ends of the conductive member can be greater than a number of turns of the coil in a central portion of the conductive member.

The fusing device can further comprise a coating layer formed on a circumference of the conductive member to reduce a frictional force between the fusing film and the conductive member.

The thickness of the conductive member at both ends of the fusing nip area can be smaller than the thickness in a central portion of the conductive member.

The width of the conductive member at both ends of the fusing nip area can be greater than the width in a central portion of the conductive member.

A temperature measuring sensor can be installed to contact an upper portion of the conductive member in the fusing nip area.

BRIEF DESCRIPTION OF THE DRAWINGS

The above aspects and advantages of the present invention will become more apparent by describing in detail exemplary embodiments thereof with reference to the accompanying drawings in which.

Throughout the drawings, it should be noted that the same or similar elements are denoted by like reference numerals.

DETAILED DESCRIPTION OF THE PREFERRED EMBODIMENTS

Figure 1:
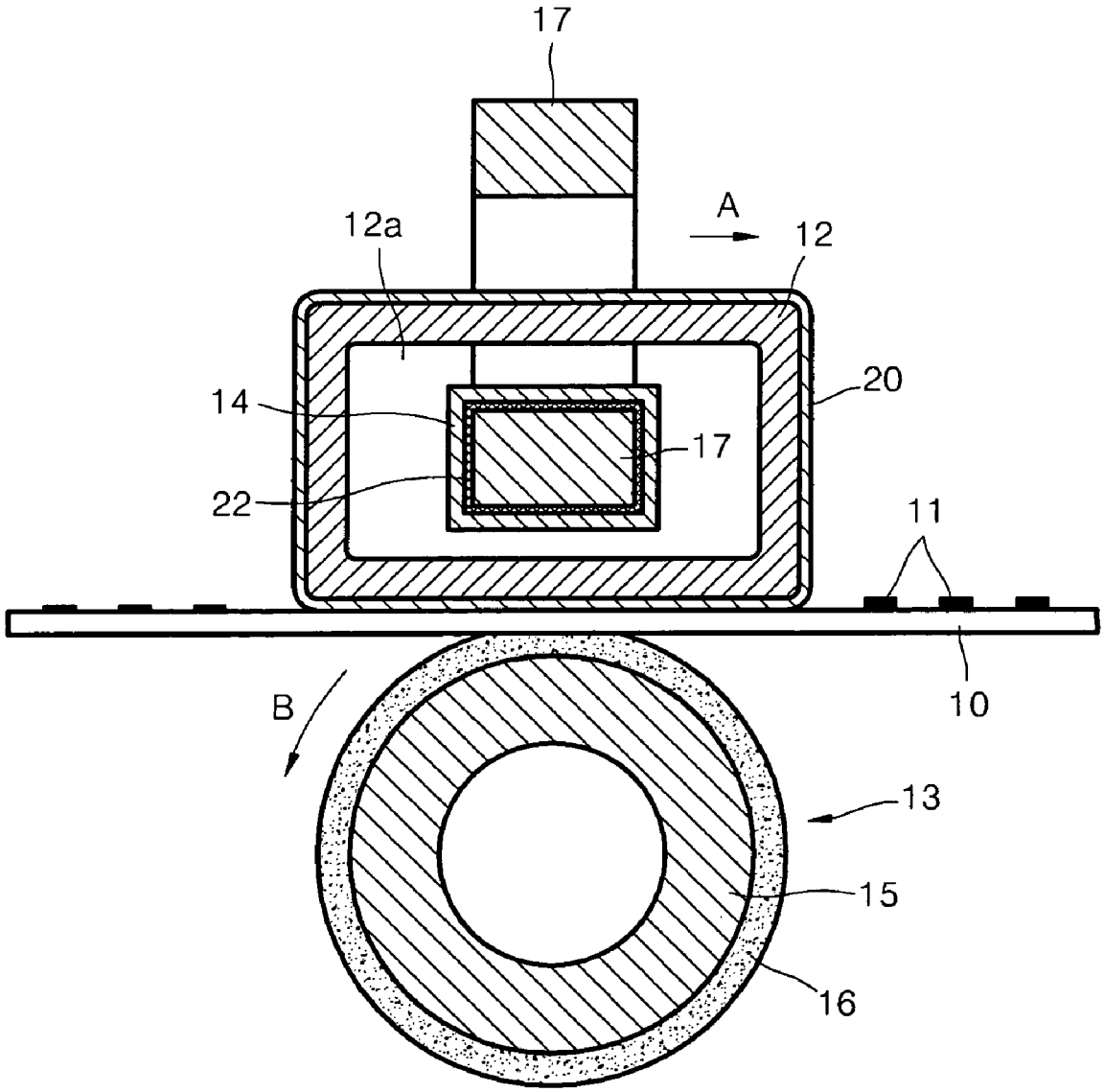
FIG. 1 (PRIOR ART)
FIGS. 1 and 2 are cross-sectional views illustrating a conventional induction heating-type fusing device disclosed in U.S. Pat. No. 6,341,211.
Figure 2:
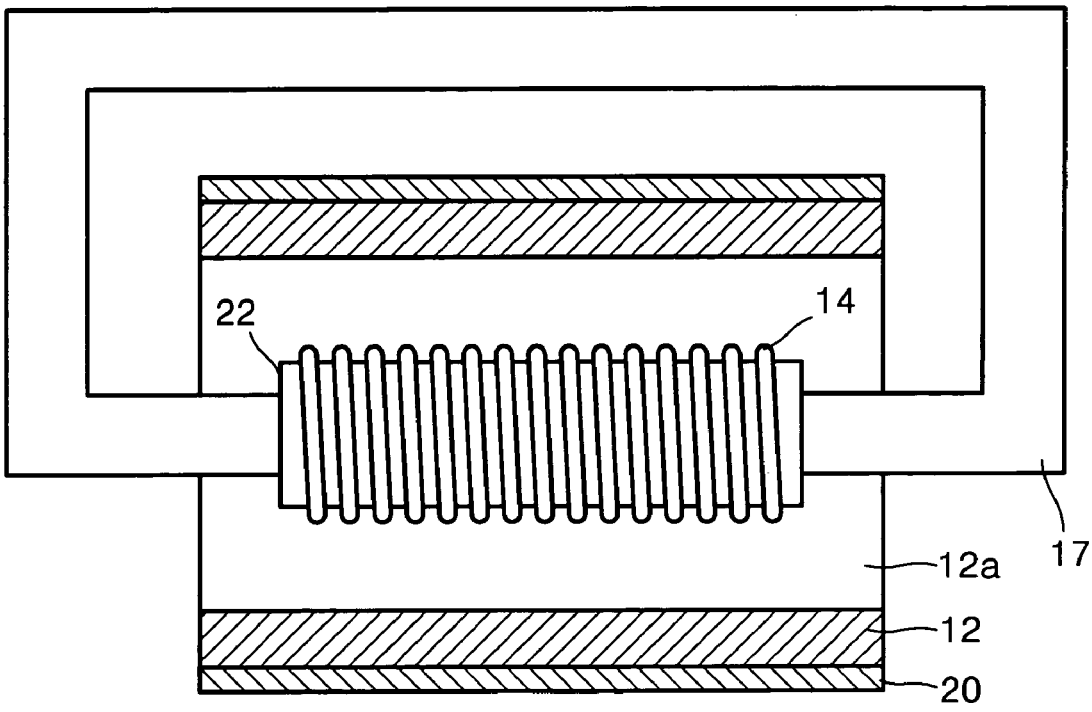
FIG. 2 (PRIOR ART)
Figure 3:
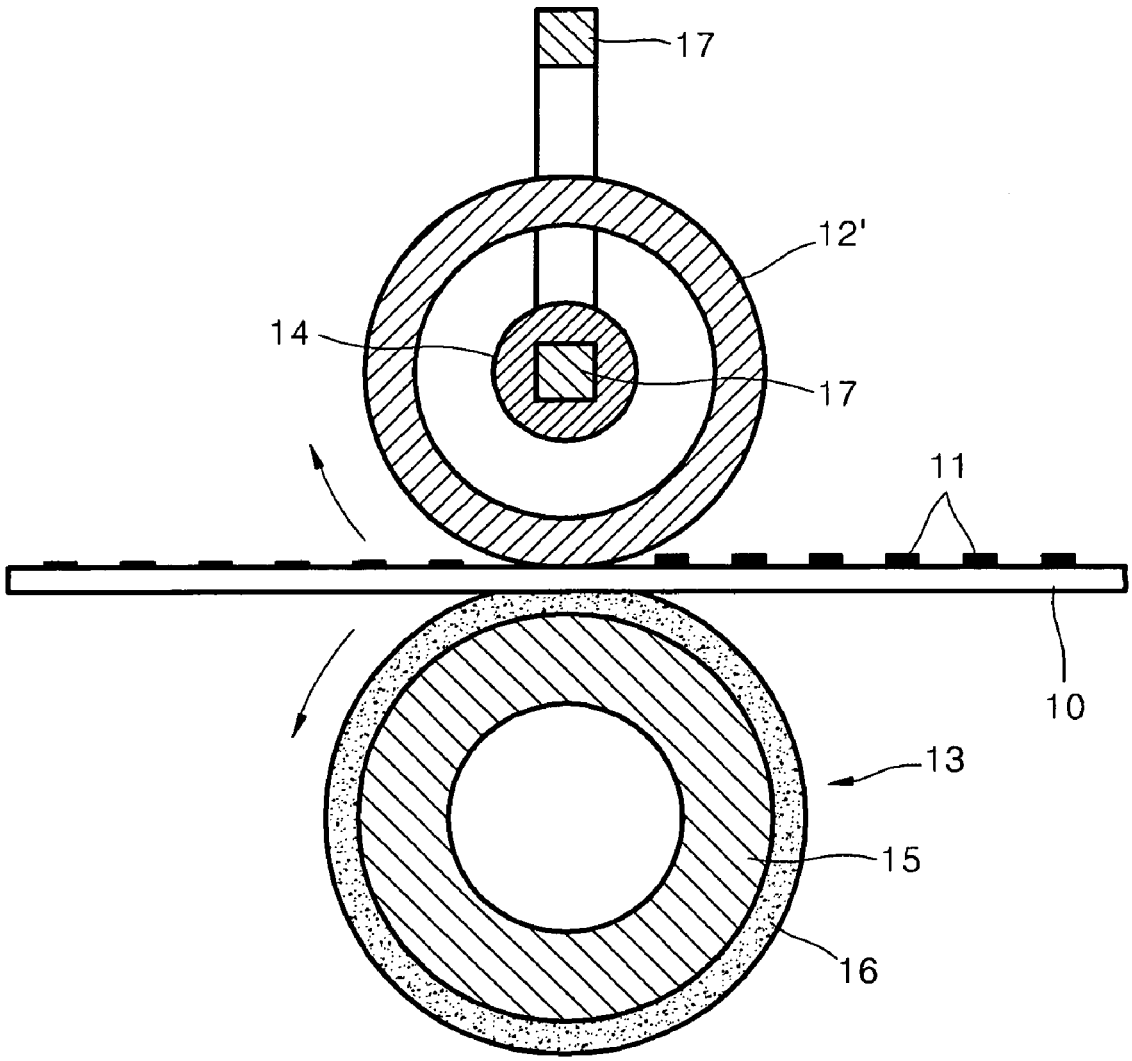
FIG. 3 (PRIOR ART)
FIG. 3 illustrates a conventional induction heating-type fusing device according to another embodiment disclosed in U.S. Pat. No. 6,341,211.

Exemplary embodiments of the present invention will now be described in detail with reference to the accompanying drawings. In the drawings, the thicknesses of layers or regions are exaggerated for illustrative purposes.

Figure 4:
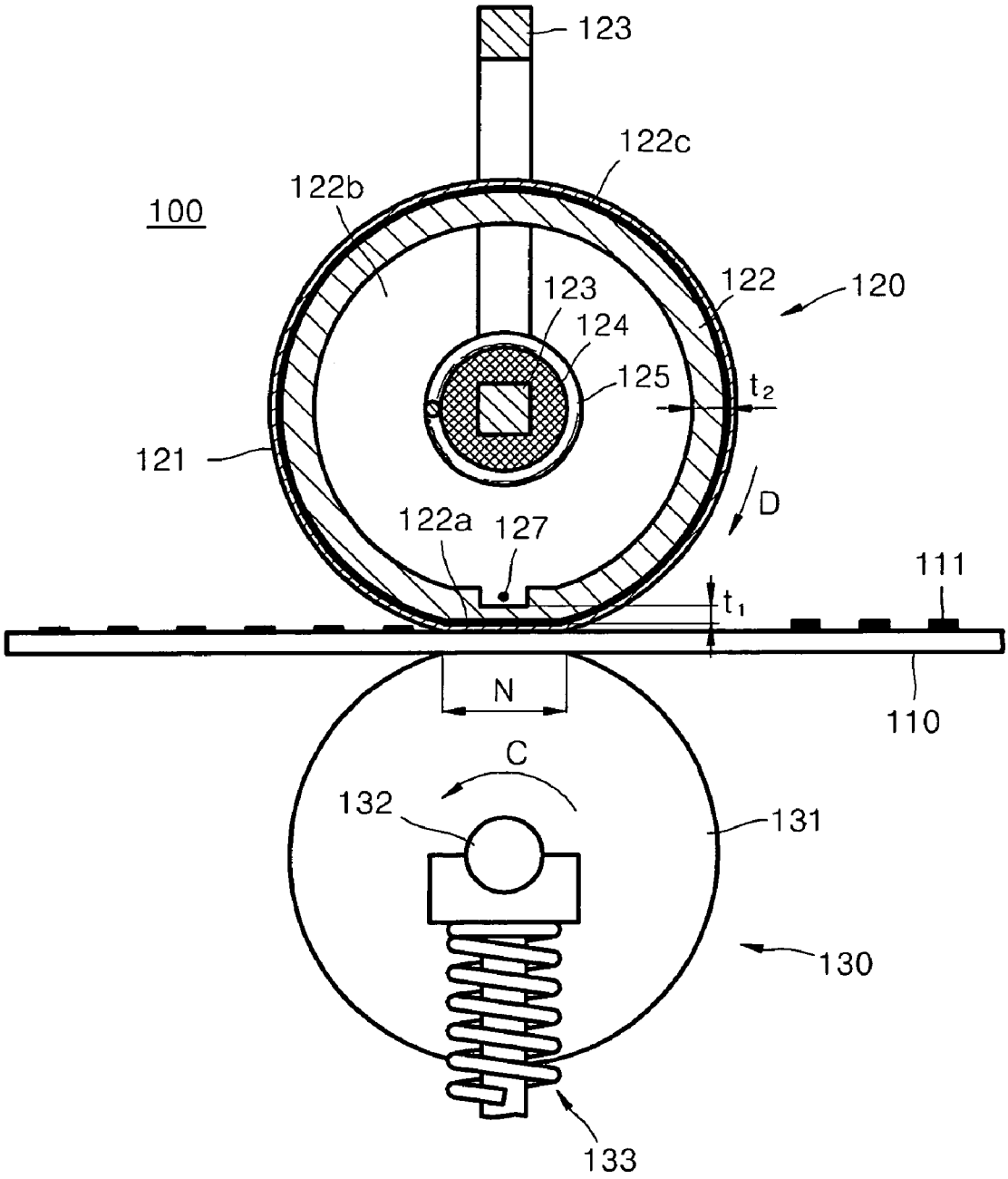
FIG. 4 is a partial cross-sectional view schematically illustrating a fusing device of an electrophotograhpic image forming apparatus according to an embodiment of the present invention.
Figure 5:
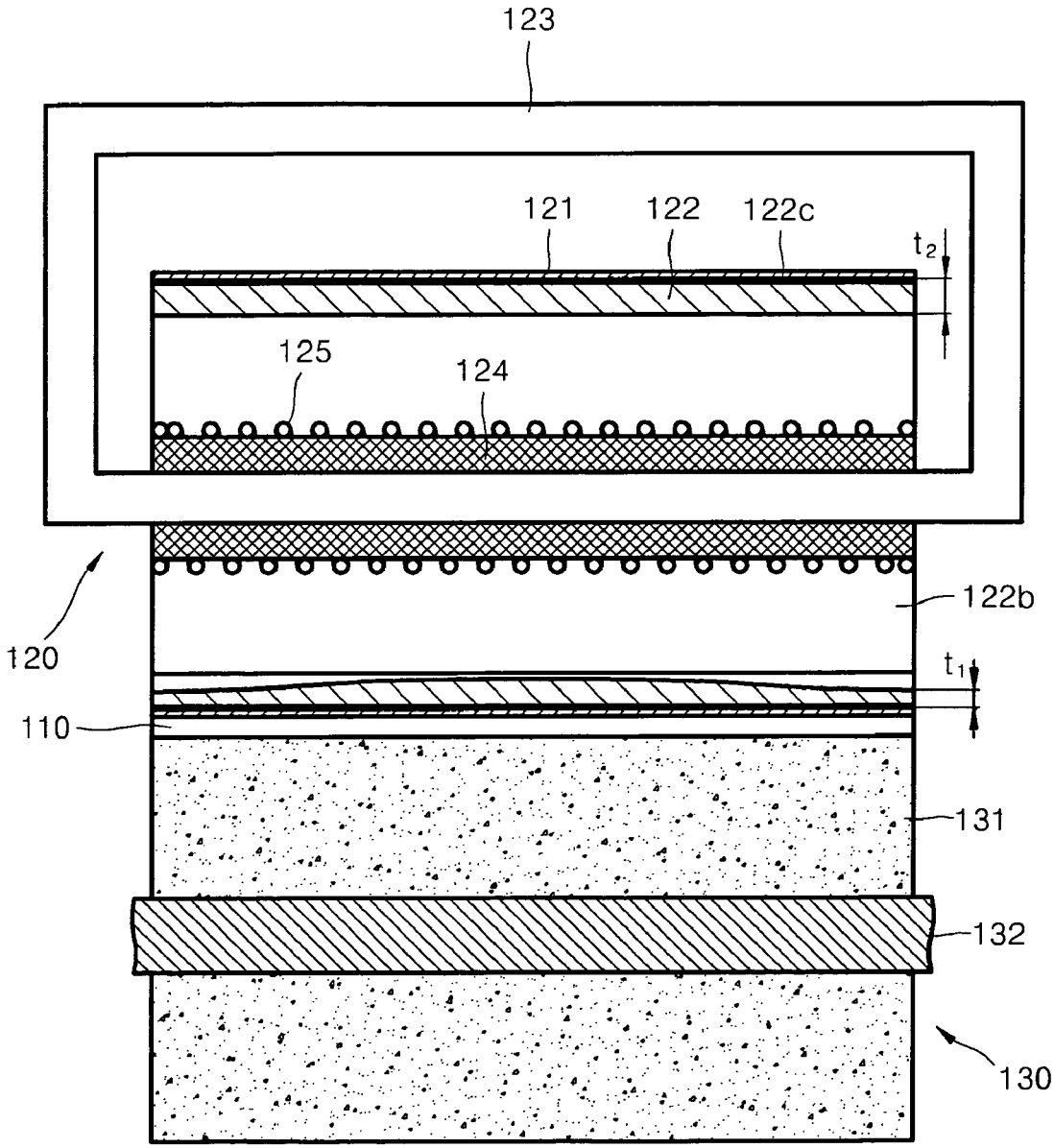
FIG. 5 is a longitudinal cross-sectional view of the fusing device of FIG. 4.

FIG. 4 is a cross-sectional view schematically illustrating the structure of a fusing device of an electrophotograhpic image forming apparatus according to an embodiment of the present invention, and FIG. 5 is a longitudinal cross-sectional view of the fusing device of FIG. 4.

A fusing device 100 includes a pressing roller 130 which is rotated in a direction of an arrow C, and a heating unit 120 which is installed to be opposite to the pressing roller 130 and fuses the toner image 111 onto the sheet of paper 110 passing between the pressing roller 130 and the heating unit 120 at a fusing nip N formed between the heating unit 120 and the pressing roller 130.

The heating unit 120 includes a fixing portion having both ends fixed and a heating element therein, and a fusing film 121 which is slid on the surface of the fixing portion. The fusing film 121 can comprise polyimide having a thickness of 50–1000 μm, and a Teflon coating (not shown) which is a toner protective layer, can be formed on a surface contacting the toner image 111.

The fixing portion includes a conductive member 122 and an induction heating part. The conductive member 122 includes a linear part 122*a* formed on one side thereof in an area corresponding to the fusing nip N and a cylindrical area having a hollow structure. The induction heating part heats the conductive member 122 by induction.

Figure 6:
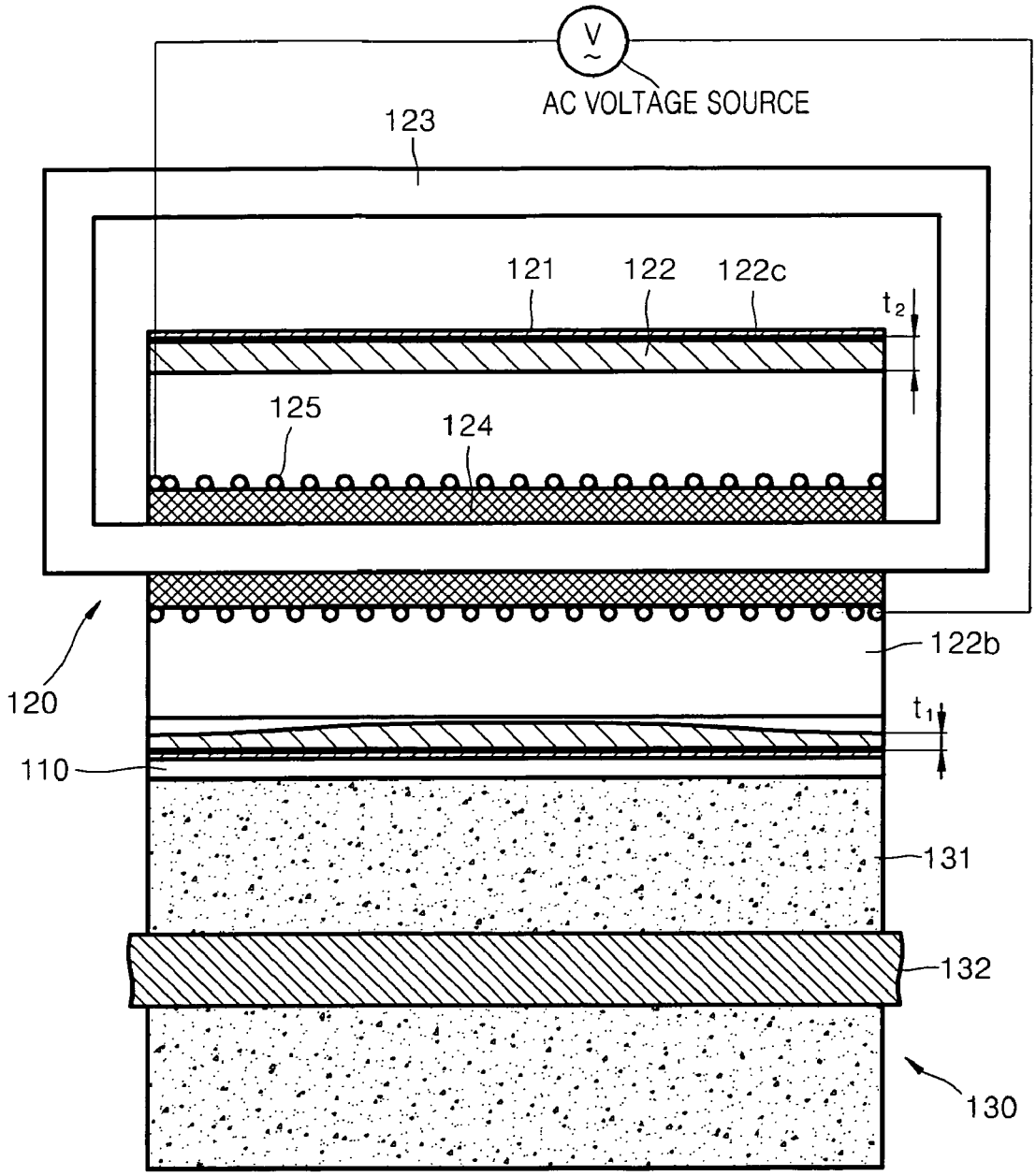
FIG. 6 illustrates a fusing device of an electrographic image forming apparatus according to an exemplary embodiment of the present invention.

The induction heating part includes a core 123 which perforates a hollow of the conductive member 122, a coil 125 which is wound in an outer circumference of the core 123 and inductively heats the conductive member 122, and an AC voltage source as illustrated in FIG. 6 which applies a predetermined AC voltage to both ends of the coil 125.

The conductive member 122 comprises conductive metal, such as a carbon steel pipe, a stainless alloy pipe, an aluminum pipe, or iron. A coating layer 122*c* which reduces a frictional force against the fusing film 121, can be formed at a circumference of the conductive member 122. The coating layer 122*c* comprises fluoric resin, such as polytetrafluoroethylene (PTFE), tetrafluoroethylene-perfluoroalkylvinylether copolymer (PFA), or tetrafluoroethylene-hexafluoropropylene copolymer (FEP), or silicon resin to a thickness of about 0.1 mm.

The core 123 forms a closed magnetic circuit. The coil 125 is wound on a portion of the circumference of the core 123 inside a hollow section 122*b* of the heating unit 120, several hundreds or thousands of times, and an insulating layer 124, for example, mica sheet is wound between the core 123 and the coil 125. The insulating layer 124 prevents electrical connection between the core 123 and the coil 125.

When an AC voltage is applied from an AC voltage source (not shown) to the coil 125, magnetic flux by which an inductive current is generated along a circumferential direction of the conductive member 122, is produced. The core 123 can comprise an iron core used in a conventional transformer and has high magnetic permeability. The conductive member 122 is heated by the inductive current.

The fusing film 121 is rotated in a direction of an arrow D. The fusing film 121 can be driven and rotated by the pressing roller 130 due to a frictional force between the pressing roller 130 and the fusing film 121 rather than by an additional driving unit.

The pressing roller 130 includes an elastic roller 131 which contacts the fusing film 121 and forms the fusing nip N, and a shaft 132 which supports the elastic roller 131 at the center of the elastic roller 131 and is rotated by a driving unit (not shown). The shaft 132 is elastically biased toward the opposite heating unit 120 using a spring member 133. The elastic roller 131 can be formed of heat-resistant silicon rubber. Due to rotation of the elastic roller 131, the fusing film 121 is driven and rotated on the circumference of the conductive member 122.

A thermistor 127 which measures a temperature of the fusing nip N, is installed above the linear portion 122*a* of the fusing nip N. The temperature of the fusing nip N is determined by the number of turns of the coil 125 and frequency and voltage from the AC voltage source.

Meanwhile, a thickness $t_1$ of an area corresponding to the fusing nip N of the conductive member 122 is different from a thickness $t_2$ of another area of the conductive member 122. When an AC of several tens to hundreds of Hz is applied from the AC voltage source to the coil 125, an AC magnetic field is formed in an axial direction around the core 123 and the coil 125, and an inductive current flows in a circumferential direction of the conductive member 122. In this case, a skin depth at which the current is generated can be given by Equation 1.

$$\delta = \sqrt{\frac{2}{\omega\mu\sigma}}$$

Here, δ is a skin depth, ω is an angular frequency, μ is magnetic permeability, and σ is an electrical conductive constant. When a thickness ($t_1$ of FIG. 4) of the fusing nip N of the conductive member 122 is smaller than the skip depth δ, a significant amount of an inductive current flowing in the circumferential direction is generated at the fusing nip N rather than in another area of the conductive member 122. The current flowing in the circumferential direction flows to a small cross section of the fusing nip N. Since resistance at the fusing nip N increases in inverse proportion to the cross section and Joule's heat at the fusing nip N is in proportion to the resistance, the thickness $t_1$ of the fusing nip N is adjusted so that the temperature of the fusing nip N can be locally increased.

When an AC having frequency of several tens or hundreds of Hz is used, the skin depth is 2–20 mm. Thus, the thickness of the fusing nip N is less than the skip depth, and the thicknesses of other areas are greater than the skin depth so that stiffness of the heating unit 120 is maintained.

Meanwhile, the thickness ti of the fusing nip N can be gradually reduced from the center toward both ends. The thickness of the conductive member 122 at the both ends of the fusing nip N is reduced so that heat loss at the both ends is compensated for and the temperature in the lengthwise direction of a fusing nip area is maintained at a constant level.

An operation of the fusing device having the above structure will be described with reference to the accompanying drawings.

First, when an AC having a frequency of several tens or hundreds of Hz is applied from an AC voltage source (not shown) to the coil 125, AC magnetic flux is generated in the core 123 wound by the coil 125. Due to the magnetic flux, an inductive current is generated in a circumferential direction of the conductive member 122 which is an adjacent conductor, and Joule's heat is generated by the inductive current. In this case, the thickness of the conductive member 122 of the fusing nip N is less than a skin depth and the fusing nip N having a thickness smaller than the thickness $t_2$ of other areas is locally and further heated and is rapidly heated to a temperature appropriate for a fusing operation, for example, 150–200° C. In addition, since the thickness of both ends of the fusing nip N is smaller than the thickness of the center of the fusing nip N, both ends of a heating unit 120 is further heated, and the temperature at both ends of the heating unit 120 is prevented from being lowered.

When a sheet of paper 110 on which toner 111 which has not yet been fused is fed into the fusing device maintained at a predetermined fusing temperature, the sheet of paper 110 enters between the heating unit 120 and a pressing roller 130, the unfused toner 111 is heated at the fusing nip N and is melted, pressed by the pressing roller 130, and is fused onto the sheet of paper 110.

A surface temperature of the fusing nip N of the conductive member 122 can be adjusted using a thermistor 127 by controlling the AC voltage and the frequency applied to the coil 125.

Figure 7:
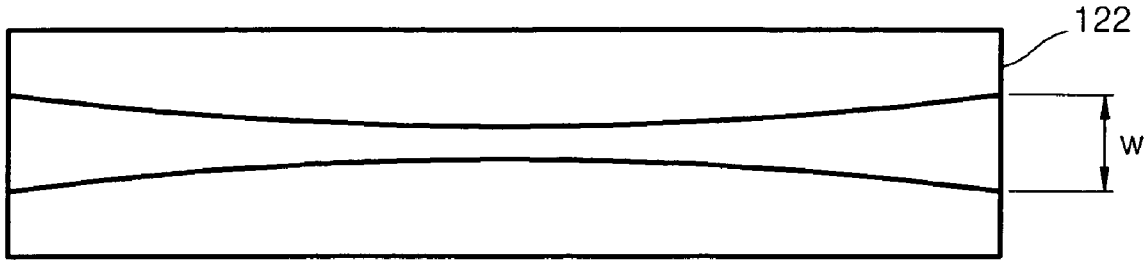
FIG. 7 illustrates a fusing device of an electrographic image forming apparatus according to another exemplary embodiment of the present invention.

According to another embodiment of the present invention as illustrated in FIG. 7, the thickness of the conductive member 122 of the fusing nip N is maintained at a constant level, and the width of the conductive member 122 is gradually increased from the center toward both ends so that heat loss at both ends of the fusing device can be compensated for.

Figure 8:
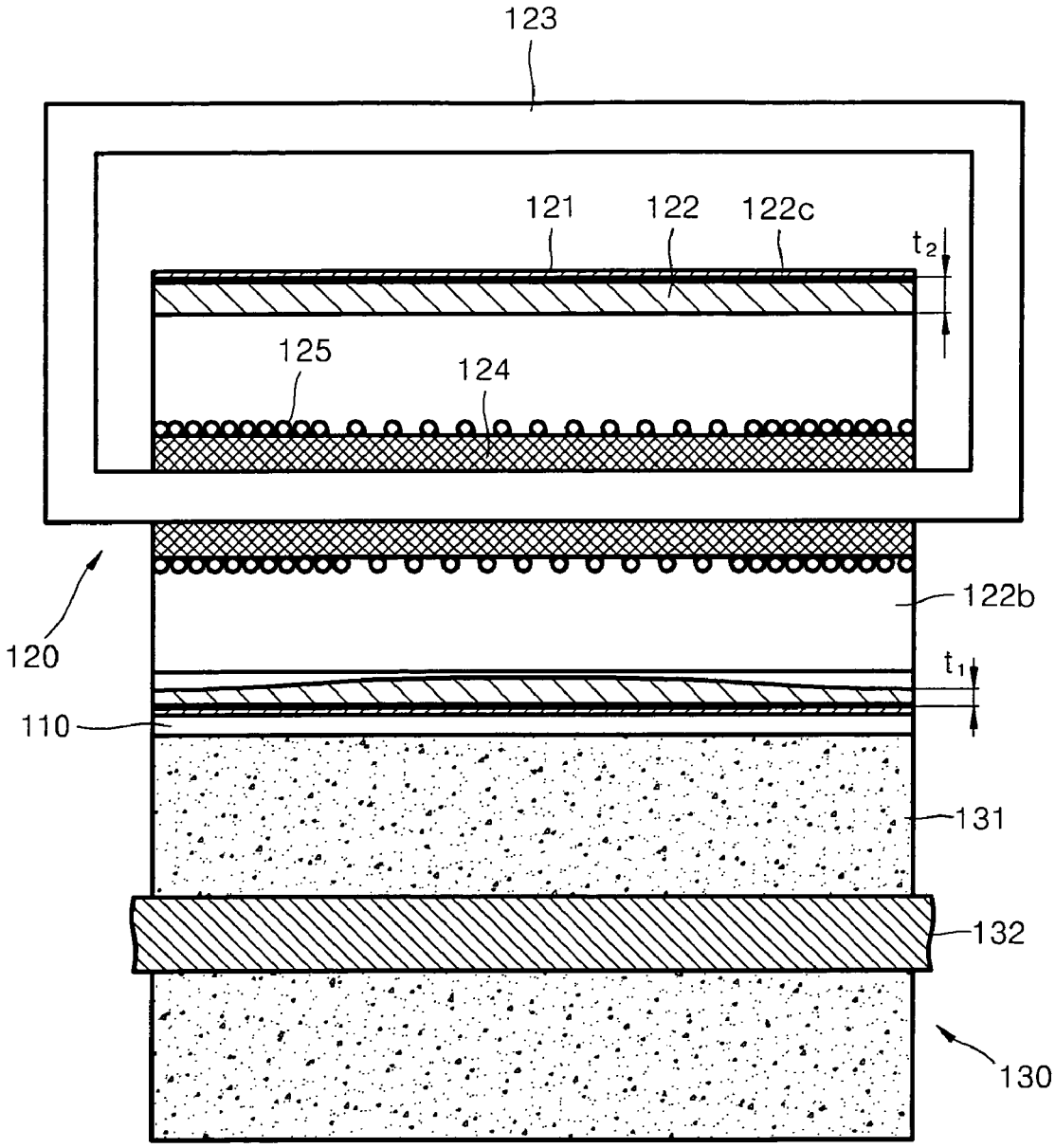
FIG. 8 illustrates a fusing device of an electrographic image forming apparatus according to yet another exemplary embodiment of the present invention.

According to another embodiment of the present invention as illustrated in FIG. 8, the number of turns of the coil 125 is gradually increased from the center toward both ends so that the temperature at both ends of the fusing device can be prevented from being lowered As described above, in the fusing device of the image forming apparatus according to an embodiment of the present invention, the thickness of a conductive member at a fusing nip is less than a skin depth and is locally heated such that heat loss in other areas can be reduced. In addition, the thickness and width of a conductive layer in an area corresponding to the fusing nip are adjusted to compensate for heat loss at both ends of the fusing device such that temperatures in a lengthwise direction of the fusing device are maintained at a constant level and an image quality is improved.

While this invention has been particularly shown and described with reference to certain embodiments thereof, it should be understood by those skilled in the art that various changes in form and details can be made therein without departing from the spirit and scope of the invention as defined by the appended claims.

What is claimed is:

1. A fusing device of an electrophotographic image forming apparatus, the fusing device comprising:

a conductive member having a linear portion for contacting a printing medium;

a fusing film for sliding on a circumference of the conductive member;

a pressing roller for contacting the fusing film in the linear portion, forming a fusing nip area, and rotating the fusing film; and an induction heating unit for heating the conductive member by induction and generating heat, wherein the thickness of the conductive member in the fusing nip area is smaller than the thickness of the conductive member in other areas.

2. The fusing device of claim 1, wherein the induction heating unit comprises:

a core for perforating a hollow of the conductive member and forming a magnetic circuit;

a coil for surrounding an outer circumference of the core spirally; and an AC voltage source for applying a predetermined AC voltage to both ends of the coil.

3. The fusing device of claim 2, further comprising an insulating layer formed between the coil and the core.

4. The fusing device of claim 2, wherein a number of turns of the coil at both ends of the conductive member is greater than a number of turns of the coil in a central portion of the conductive member.

5. The fusing device of claim 1, further comprising a coating layer formed on a circumference of the conductive member for reducing a frictional force between the fusing film and the conductive member.

6. The fusing device of claim 1, wherein the thickness of the conductive member at both ends of the fusing nip area is smaller than the thickness in a central portion of the conductive member.

7. The fusing device of claim 1, wherein the width of the conductive member at both ends of the fusing nip area is greater than the width in a central portion of the conductive member.

8. The fusing device of claim 1, wherein a temperature measuring sensor is installed for contacting an upper portion of the conductive member in the fusing nip area.

9. A method of fusing an image in an electrophotographic image forming device comprising:

contacting a printing medium via a conductive member having a linear portion;

sliding a fusing film on a circumference of the conductive member;

contacting the fusing film in the linear portion via a pressing roller, forming a fusing nip area, and rotating the fusing film; and heating the conductive member by induction and generating heat via an induction heating unit, wherein the thickness of the conductive member in the fusing nip area is smaller than the thickness of the conductive member in other areas.

10. The method of claim 9 further comprising:

perforating a hollow of the conductive member and forming a magnetic circuit via a core;

surrounding an outer circumference of a core spirally; and applying a predetermined AC voltage to both ends of the coil via an AC voltage source.

11. The method of claim 10, further comprising:

providing an insulating layer between the coil and the core.

12. The method of claim 10, wherein a number of turns of the coil at both ends of the conductive member is greater than a number of turns of the coil in a central portion of the conductive member.

13. The method of claim 9, further comprising:

providing a coating layer on a circumference of the conductive member for reducing a frictional force between the fusing film and the conductive member.

14. The method of claim 9, wherein the thickness of the conductive member at both ends of the fusing nip area is smaller than the thickness in a central portion of the conductive member.

15. The method of claim 9, wherein the width of the conductive member at both ends of the fusing nip area is greater than the width in a central portion of the conductive member.

16. The method of claim 9, further comprising:

contacting an upper portion of the conductive member in the fusing nip area via a temperature measuring sensor.

* * * * *